US009010067B2

(12) United States Patent
Baker et al.

(10) Patent No.: US 9,010,067 B2
(45) Date of Patent: Apr. 21, 2015

(54) FABRICATING THE LOCKING STEPS IN THE GROOVE ELEMENT OF SPRING-LOADED SPLIT-TONGUE LOCKING CONNECTOR SYSTEM

(76) Inventors: Geoffrey Alan Baker, Sandisfield, MA (US); Nicholas Gerrard Vitale, Albany, NY (US)

( * ) Notice: Subject to any disclaimer, the term of this patent is extended or adjusted under 35 U.S.C. 154(b) by 0 days.

(21) Appl. No.: 13/086,424

(22) Filed: Apr. 14, 2011

(65) Prior Publication Data

US 2012/0260602 A1 Oct. 18, 2012

(51) Int. Cl.

| | |
|---|---|
| ***E04F 13/08*** | (2006.01) |
| ***E04F 15/04*** | (2006.01) |
| ***E04F 15/10*** | (2006.01) |

(52) U.S. Cl.

CPC ..... *E04F 15/04* (2013.01); *E04F 15/10* (2013.01); *E04F 2201/0115* (2013.01); *E04F 2201/0535* (2013.01)

(58) Field of Classification Search

USPC ..... 52/588.1, 582.1, 582.2, 586.1, 749.19, 52/749.2, 747.1, 391, 585.1

See application file for complete search history.

(56) References Cited

U.S. PATENT DOCUMENTS

| | | | | |
|---|---|---|---|---|
| 6,460,306 | B1 * | 10/2002 | Nelson | 52/582.1 |
| 6,675,545 | B2 * | 1/2004 | Chen et al. | 52/586.1 |
| 6,729,091 | B1 * | 5/2004 | Martensson | 52/391 |
| 6,763,643 | B1 * | 7/2004 | Mårtensson | 52/586.1 |
| 6,769,217 | B2 * | 8/2004 | Nelson | 52/582.1 |
| 7,021,019 | B2 * | 4/2006 | Knauseder | 52/588.1 |
| 7,677,005 | B2 * | 3/2010 | Pervan | 52/582.1 |
| 7,841,145 | B2 * | 11/2010 | Pervan et al. | 52/395 |
| 7,866,111 | B2 * | 1/2011 | Johansson | 52/588.1 |
| 7,908,816 | B2 * | 3/2011 | Grafenauer et al. | 52/586.2 |

* cited by examiner

*Primary Examiner* — Beth Stephan

(74) *Attorney, Agent, or Firm* — Oakwood Law Group, LLP

(57) ABSTRACT

A method of mechanically joining wood panels side edge to side edge by providing a panel with a groove between a top and bottom surfaces of the panel having two holding ramps with an angle of between 25 degrees and 60 degrees relative to the groove insertion axis which is parallel to the top surface; providing a connector adapted to mate with the groove of the panel having two right-side sub-tongues extending from right side and two left-side sub-tongues extending from the left side of a rectangular base support, and outward extending distal catches on the sub-tongues in a direction substantially normal to the groove insertion axis; and inserting the sub-tongues with distal catches into the groove along the groove insertion axis allowing the distal catches on the two right-side or two left-side sub-tongues to touch the two holding ramps causing the sub-tongues to flex.

10 Claims, 8 Drawing Sheets

Ft
Fn
Fr
Fb
38
40.3°
38.1°
10.8°

FABRICATING THE LOCKING STEPS IN THE GROOVE ELEMENT OF SPRING-LOADED SPLIT-TONGUE LOCKING CONNECTOR SYSTEM

BACKGROUND OF THE INVENTION

1. Field of Invention

The present invention relates to the method by which the holding steps are formed into the panel grooves of the spring-loaded split-tongue locking tongue connector of utility U.S. patent application Ser. No. 12/705,593, EFS ID 7006498 of Baker and Vitale on a method for "Laying and Mechanically Joining Building Panels or Construction Elements". The panels of the above application are joined via an auxiliary connector element which engages suitably shaped panel grooves formed in the construction panels as shown schematically below. The resulting connector tongue and panel groove combination is referred to as a "spring-loaded split-tongue locking connector system". The grooves are fabricated into the construction panels in such a manner as to not result in the loss of panel surface material, or damage to the panel surface material resulting from the use of a through fastener. The tongues on the connector element are split tongues having one or more tongue grooves that divide the split tongue into two or more sub-tongues. The connector sub-tongues are able to flex toward each other to permit ease of installation of the auxiliary connector into the construction panel. The sub-tongues have catches integrated into their distal ends; and the panel grooves have mating steps integrated into their side walls. Upon installation of the split tongue into the panel groove, the spring action of the sub-tongues cause the suitably located and shaped sub-tongue catches to engage the panel groove steps. The sub-tongue catch and panel groove step, once engaged interact with each other in such a manner as to further pull the split-tongue into the panel groove and to hold or lock the auxiliary connector and construction panel together. The resulting connector tongue and panel groove combination is referred to as a "spring-loaded split-tongue locking connector system". The split tongues on the auxiliary connector and its mating panel groove can be arranged to allow either lateral mating, in which the tongue is inserted into the groove in a direction parallel to the panel surface; or normal mating, in which the tongue is inserted into the groove in a direction that is normal to the panel surface. The insertion and locking operation of spring-loaded split-tongue locking connector system has been demonstrated to operate as described above via number of small (1.5" long) prototypical demonstrators in both the lateral and normal mating configurations.

2. Description of Related Art

The present invention relates to the fabrication of the side-wall steps in the panel groove are of the panel elements. In the drawings associated with U S patent application Ser. No. 12/705,593, the steps are shown as being cut into the panel groove at a large angle of 75° to 85° relative to the groove axis (i.e., the direction of tongue insertion). For economical commercial production, these steps must be cut at high speed, typically 360 linear feet per minute. The geometry of steps in the above referenced patent application limits production fabrication to the use of one of two well-known cutting tools: a rotary router cutter or a linear broach cutter. Unfortunately, both cutting techniques are incapable of cutting the requisite steps at rates approaching those required for economical commercial production rates due to excessive tool heating and cutting chip removal difficulties.

SUMMARY OF INVENTION

The present invention addresses the primary impediment to economical commercial production of a spring-loaded split-tongue locking connector system, i.e., the large angle of the groove step. Rather than using a large angle relative to the groove axis of 75° to 85°, the angle is reduced to a smaller value of between 25° to 65°. This smaller angle, while still remaining under the cover of the previous patent application claims, allows step fabrication to be performed using a third well-known fabrication tool more suited to economical high-speed production: the rotary circular saw.

It is not obvious that this modification to step angle can be made for two reasons: if the step is made too small the holding feature of the catch and step is compromised, but if the angle is made too large, while still being able to be cut with a circular saw, the panel groove may become excessively wide and the structural integrity of the connector system is compromised.

Finally, it has been observed that a substantial increase in desirable performance characteristics has been realized with the current groove geometry. It is therefore the intention of the inventors to include the fabrication of the aforementioned groove, by any means, whether circular sawblade type cutters, larger more complex rotary cutters, or a rotary router bit type cutter, within the scope of this patent application. In short, no matter the means whereby this groove has been fabricated, it is intended that it remain within the scope of the protection afforded by this invention.

In an exemplary embodiment of the present invention, there is disclosed a method of mechanically joining wood panels side edge to side edge comprises:

cutting grooves into the side edges of at least two panels that are to be joined together with a connector with no loss of top or bottom panel surface;

cutting a first step edge groove into the side edge of a panel at an angle "s";

cutting a second step edge opposite the first step edge groove into the side edge of the panel at an angle "s" of between 10 degrees and 75 degrees;

cutting an angle "e" of an entrance ramp along the first step edge groove at an angle of between 0 degrees and 45 degree;

cutting an angle "e" of the entrance ramp along the second step edge groove at an angle of between 0 degrees and 45 degrees; and The more important features of the invention have thus been outlined in order that the more detailed description that follows may be better understood and in order that the present contribution to the art may better be appreciated. Additional features of the invention will be described hereinafter and will form the subject matter of the claims that follow.

Before explaining at least one embodiment of the invention in detail, it is to be understood that the invention is not limited in its application to the details of construction and the arrangements of the components set forth in the following description or illustrated in the drawings. The invention is capable of other embodiments and of being practiced and carried out in various ways. Also it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

The foregoing has outlined, rather broadly, the preferred feature of the present invention so that those skilled in the art may better understand the detailed description of the invention that follows. Additional features of the invention will be described hereinafter that form the subject of the claims of the invention. Those skilled in the art should appreciate that they can readily use the disclosed conception and specific embodiment as a basis for designing or modifying other structures for carrying out the same purposes of the present invention and that such other structures do not depart from the spirit and scope of the invention in its broadest form.

BRIEF DESCRIPTION OF THE DRAWINGS

Other aspects, features, and advantages of the present invention will become more fully apparent from the following detailed description, the appended claim, and the accompanying drawings in which similar elements are given similar reference numerals.

FIG. 6 is a detail of the sub-tongue holding force and sub-tongue bending force components of the resultant force acting at the point of contact between the distal end of a sub-tongue and its mating groove step; and.

DESCRIPTION OF PREFERRED EMBODIMENT

Figure 1:
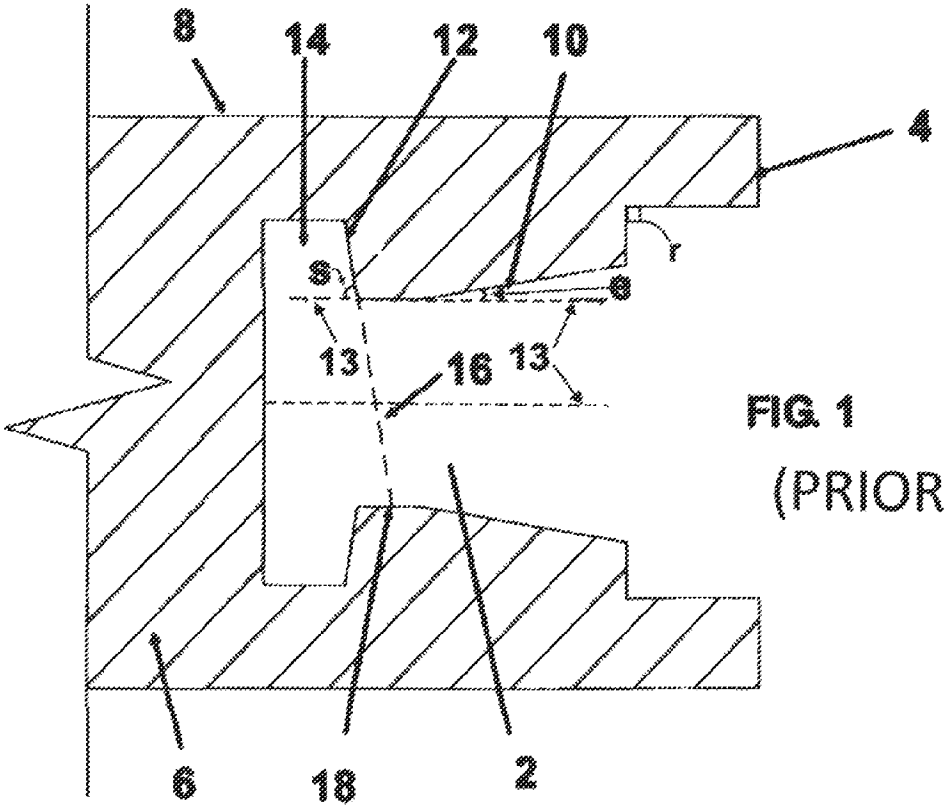
FIG. 1 (PRIOR ART)
FIG. 1 is a side views of the groove of the prior art.

FIG. 1 is a side view of the groove element of the prior art spring-loaded, split-tongue, locking connector system of applicants U.S. patent application Ser. No. 12/705,593. The groove 2 is fabricated into the edge 4 of structural panel 6 in such a manner as to not result in the loss of panel surface 8. The groove geometry has two types of angles associated with it: angle "e", the angle of the entrance ramp 10 relative to the groove insertion axis 13 which is the direction of tongue insertion, and angle "s", the angle of step edge (i.e. "holding ramp") 12 of sidewall step 14 relative to the groove insertion axis 13. The groove geometry is symmetric. Thus, the groove has two "e" angles and two "s" angles. The dotted extrapolation 16 of step edge 12 intersects the opposite groove sidewall at point 18. In addition, the groove geometry has two right angles "r" near the entry of the groove.

Figure 2B:
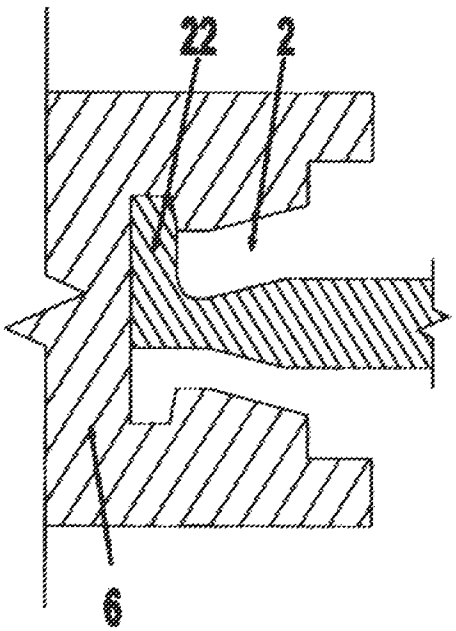
FIG 2B Prior Art
FIGS. 2A, and 2B, show side views of the prior art showing how a rotary router type cutter or a linear broach type cutter may be used to cut the sidewall grooves shown in FIG. 1.
Figure 2A:
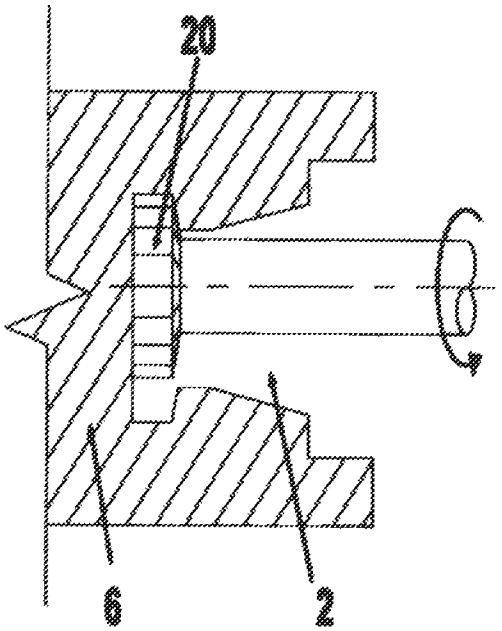
FIG 2A Prior Art

The fact that the extrapolation of step edge (i.e. "holding ramp") 12 intersects the opposite sidewall precludes the use of a circular saw to cut the step into the sidewall and restricts the step to be cut using a well-known rotary router type cutter 20 as shown in FIG. 2A. A router type cutter has an array of uniformly shaped cutting teeth spaced symmetrically about the cutter axis of rotation. Alternatively, the step of FIG. 1 can be cut using a broach type cutter 22 as shown in FIG. 2B. The broach type cutter has a large number of teeth of gradually increasing depth arrayed to cut in the direction into the paper. The broach type cutter cuts the step by being pulled linearly through the groove in the direction into the paper. Both the rotary router type cutter and the linear broach type cutter can be used to cut grooves of the shape shown in FIG. 1. However, neither cutter type has proven suitable due to tool heating and chip removal difficulties for groove manufacture at cutting rates required for economical commercial production.

Figure 3:
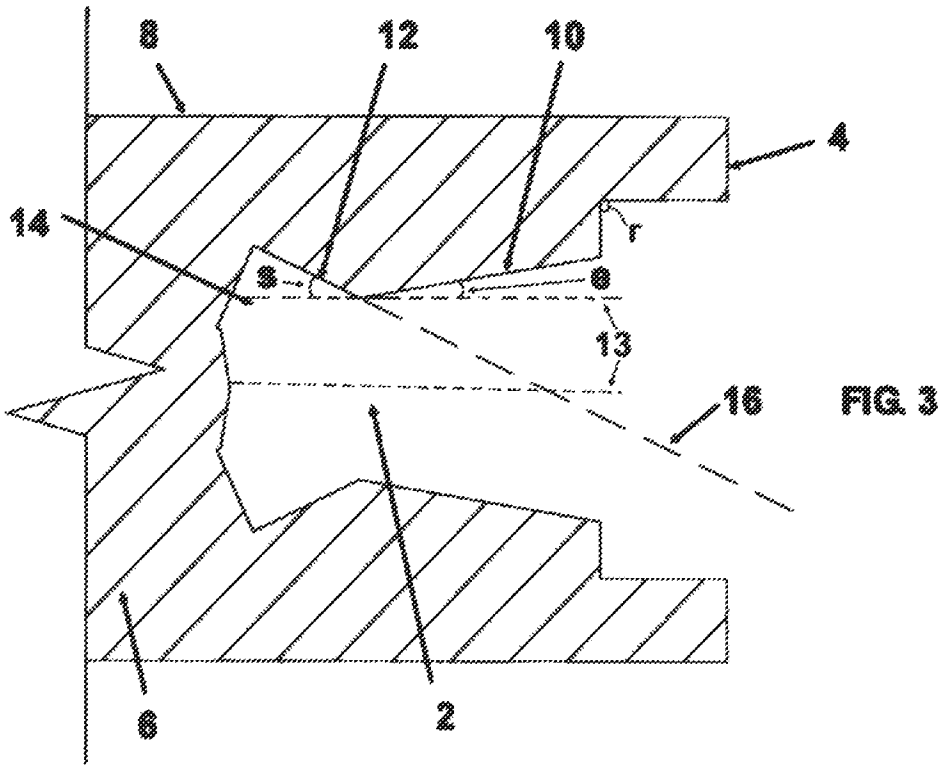
FIG. 3 is a side view of the groove of the present invention.

As shown in FIG. 3, to allow the panel groove 2 to be cut with a circular saw, the angle s of step edge (i.e. "holding ramp") 12 in FIG. 1 must be reduced so that the dotted extrapolation 16 of the step edge (i.e. "holding ramp") 12 no longer intersects the opposite groove sidewall. The same features of FIGS. 1 and 3 have the same reference numerals.

Figure 4A:
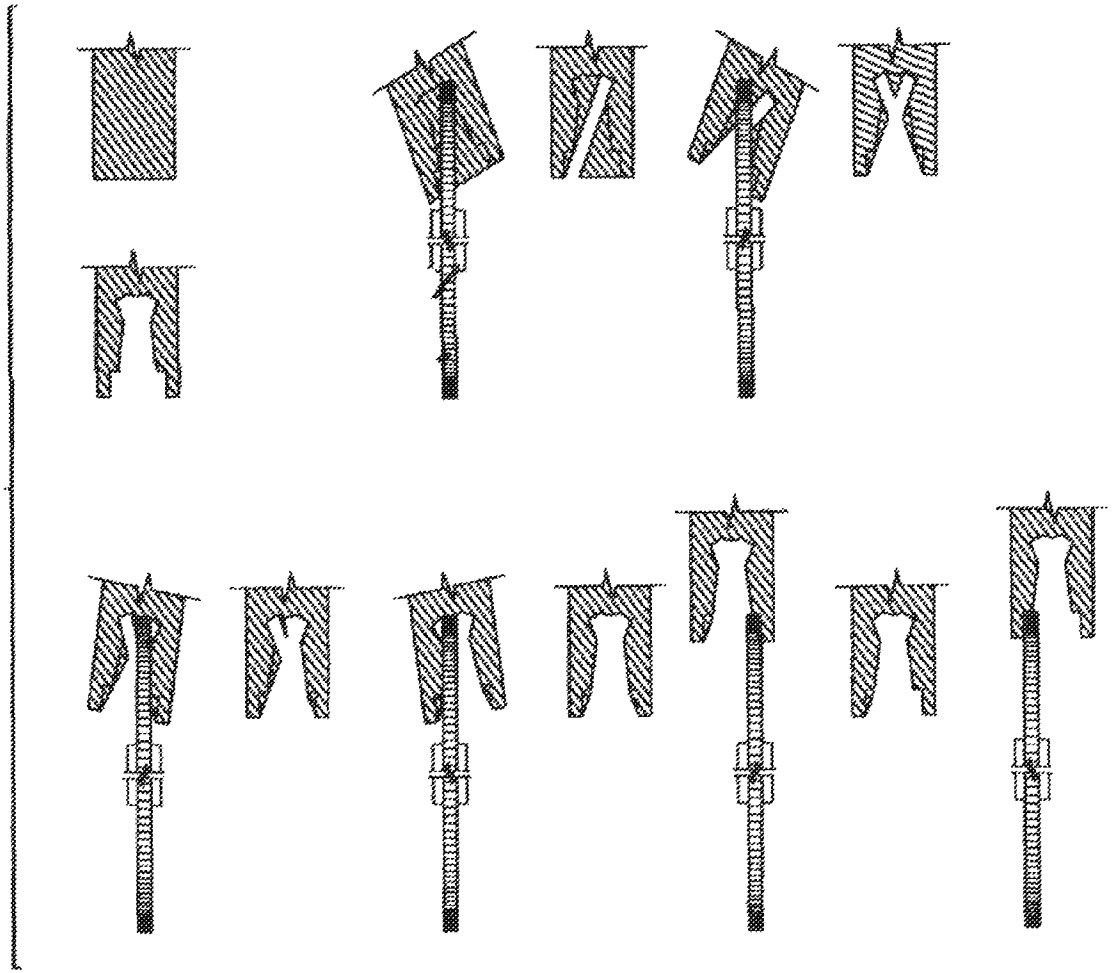
FIGS. 4A and 4B shows side views the various steps in which a circular saw type cutter may be used to cut the groove shown in FIG. 3.
Figure 4B:
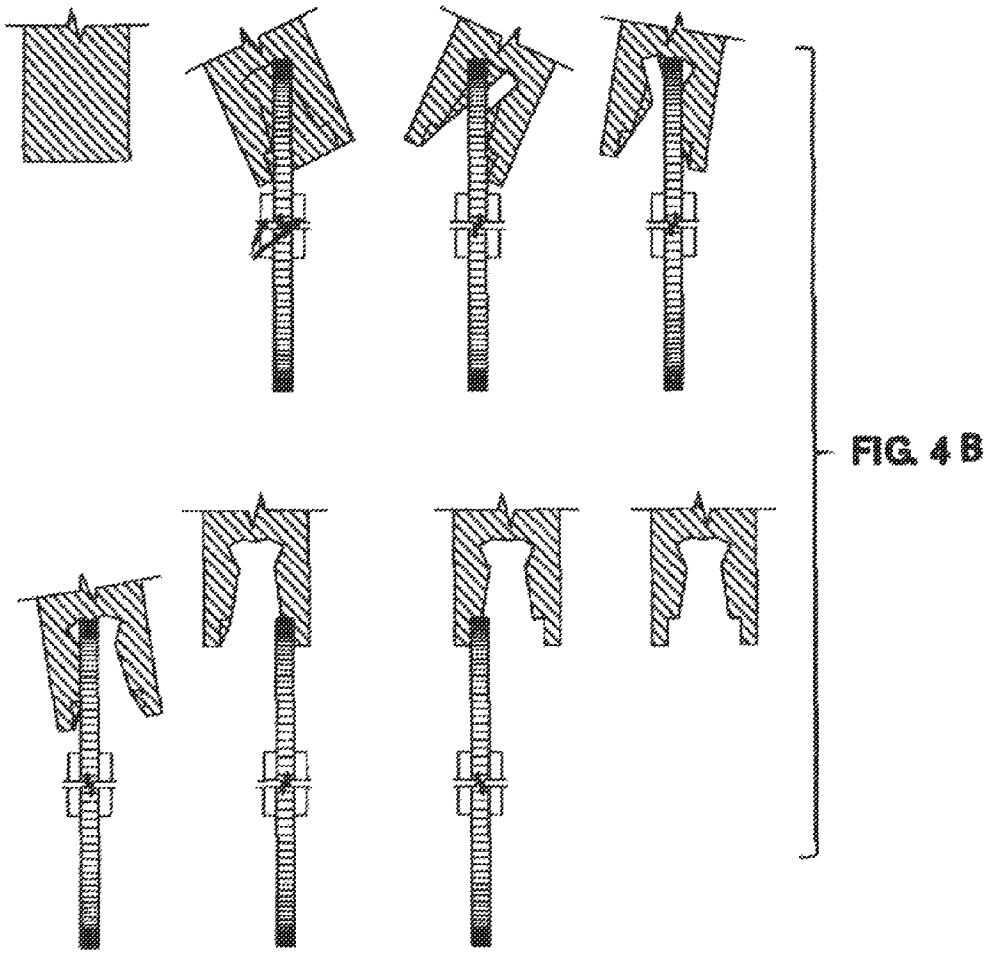

The manner in which reduction of the step angle s allows the groove to be cut using a sequence of six high speed circular saw cuts is shown in FIG. 4A.

It is not obvious that the groove modification shown in FIG. 3 will result in a successful connector system for two reasons: if the step is made too small it will compromise the holding feature of the catch and step elements of the connector system, but if the angle is made too large, yet still being able to be cut with a circular saw tool, it can cause the panel groove to become excessively wide, compromising the structural integrity of the connector system. In the following it is shown that the angle s can be reduced to angles between 25° and 65° without compromising the holding strength of the connector.

Figure 5:
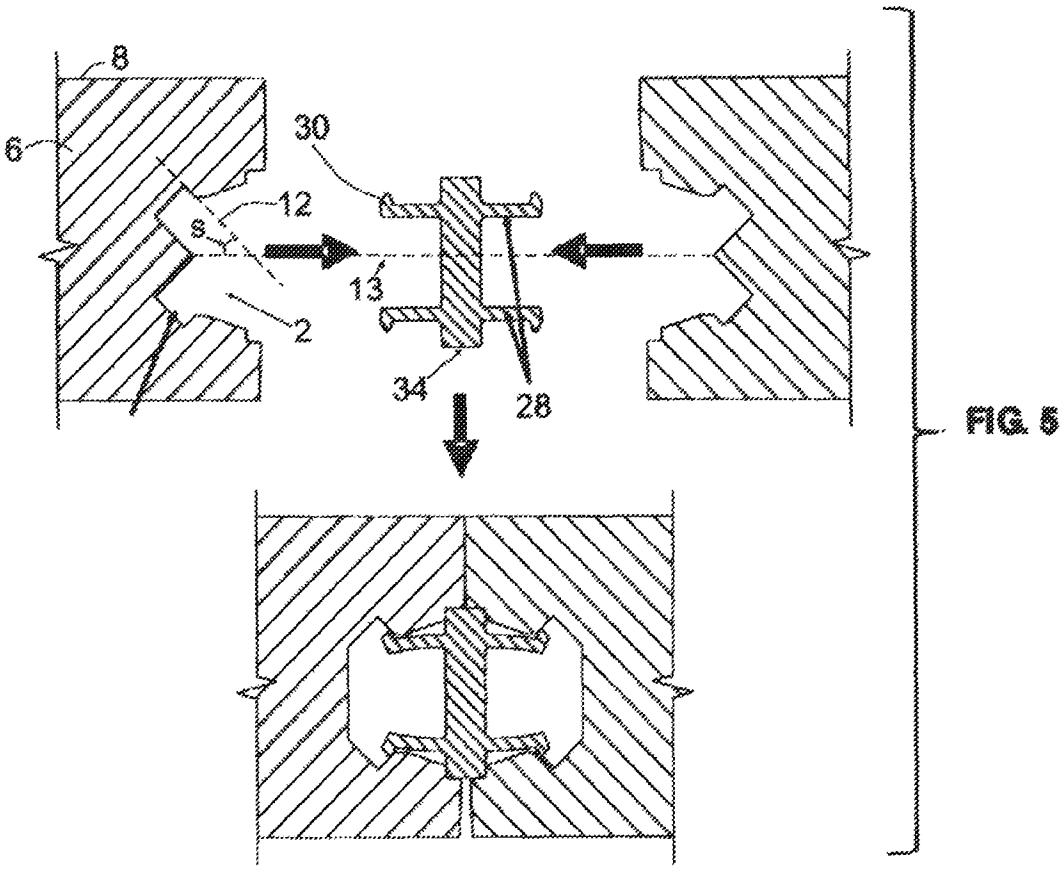
FIG. 5 is a side view of the connector showing the manner in which the sub-tongues flex inward as the connector is inserted in the groove of FIG. 3.

The manner in which the modified groove mates with a corresponding modified connector to form the spring-loaded split-tongue locking connector system is shown in FIG. 5.

Figure 6:
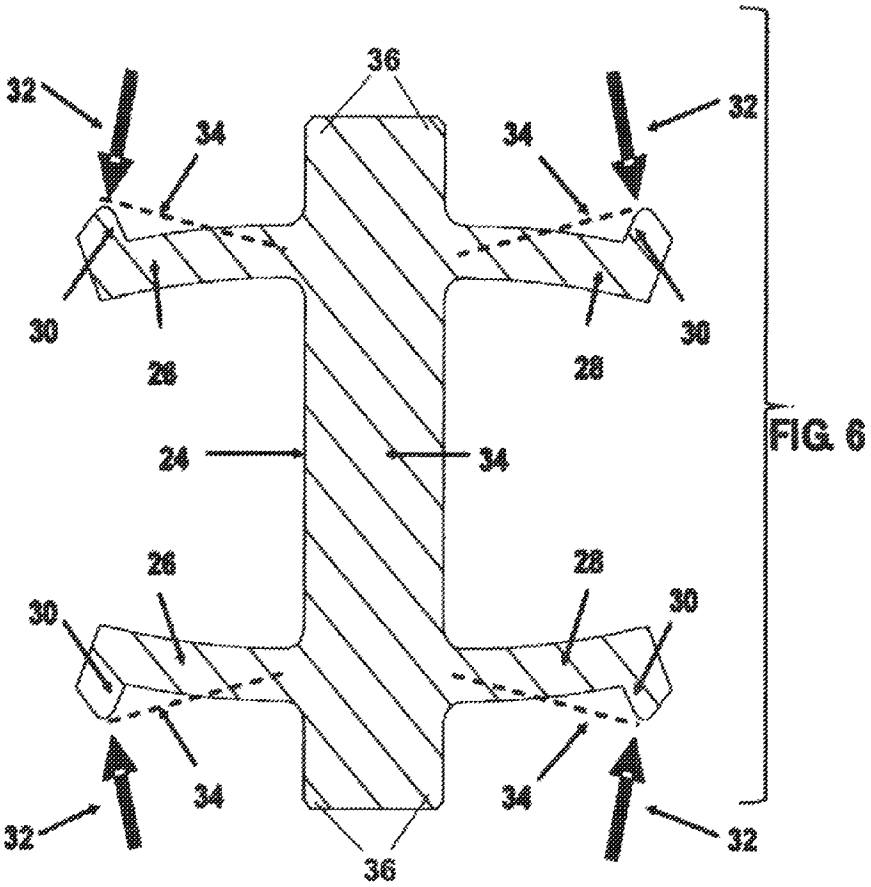

FIG. 6 is a side view of the connector 24 modified to mate with the modified panel groove shown in FIG. 3. FIG. 6 shows two sub-tongues 26 extending from the left side of the connector 24, and two sub-tongues 28 extending from the right side of connector 24. Each sub-tongue has a catch 30 at its distal end. Each sub-tongue has a bending force 32 acting on its distal catch by the panel groove. The bending force 32 acts on a moment arm 34 to bend the sub-tongues in cantilever fashion about the center beam (i.e. base support element) 34 of the connector 24 of which the right-angle corners 36 are adapted to fit into the right angles "r" of the panel groove.

Figure 7:
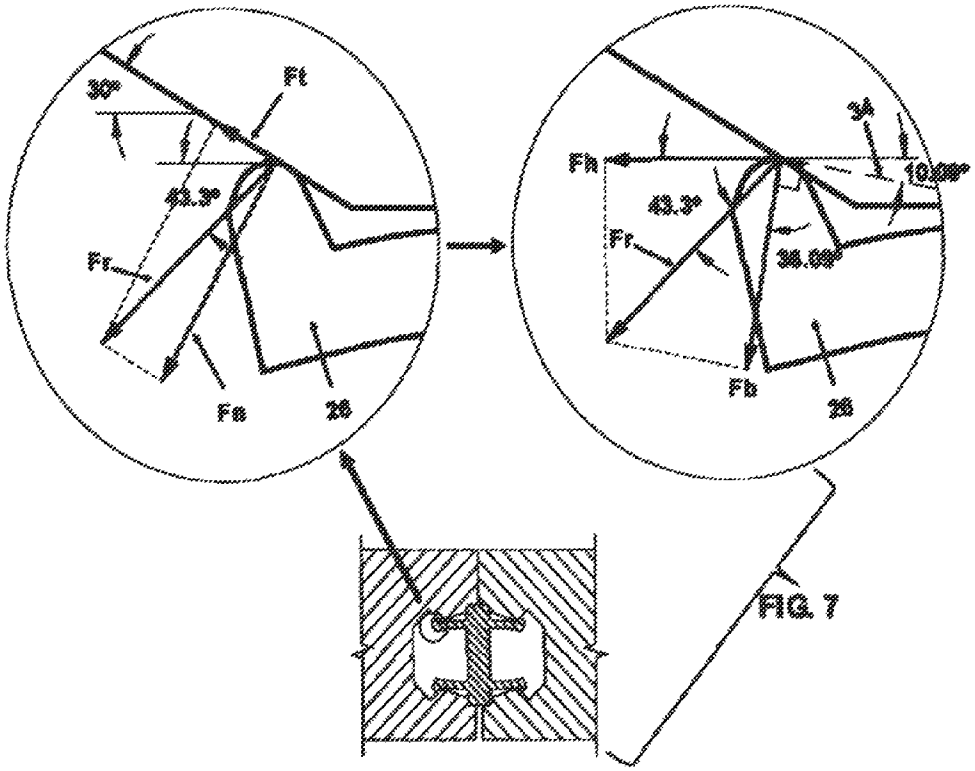
FIG. 7 is a side view showing forces acting on the sub-tongue arms of the connector.

The upper left detail in FIG. 7 shows the normal force Fn and the friction force Ft acting on sub-tongue catch 30 at the point where it contacts step edge (i.e. "holding ramp") 12 of FIG. 3.

The step edge (i.e. "holding ramp") 12 is at an angle of s=30° above the horizontal line which is the groove insertion axis 13 and the associated normal force is therefore 60° below the horizontal. The force acting normal to the side wall edge is denoted by Fn, and the resulting friction force resisting removal of the connector from the groove is denoted by Ft in FIG. 7.

Looking now at the forces in the upper right detail in FIG. 7, the moment arm 34 bending the sub-tongue (i.e. flexing arms) 26 is at an angle a=10.° 09° below the horizontal. The bending force Fb acts normal to moment arm 34 and is at an angle of about 36.° 09° relative to the resultant force Fr. The horizontal holding force, Fh, holding the connector in the groove is at an angle of about 43.3° relative to the resultant force Fr. Thus, even at an angle "s" of step edge 12 as low as 30°, the panel with its groove modified to allow high speed commercial production via six high-speed sequential saw cuts, is able to generate an acceptable magnitude of horizontal holding force.

While there have been shown and described and pointed out the fundamental novel features of the invention as applied to the preferred embodiments, it will be understood that the foregoing is considered as illustrative only of the principles of the invention and not intended to be exhaustive or to limit the invention to the precise forms disclosed. Obvious modifications or variations are possible in light of the above teachings. The embodiments discussed were chosen and described to provide the best illustration of the principles of the invention and its practical application to enable one of ordinary skill in the art to utilize the invention in various embodiments and with various modifications as are suited to the particular use contemplated All such modifications and variations are within the scope of the invention as determined by the appended claims when interpreted in accordance with the breadth to which they are entitled.

What is claimed is:

1. A method of joining a panel to a connector comprises:

providing a panel with a groove between a top surface and a bottom surface of the panel, the groove having opposing sidewalls, a first holding ramp in one of the sidewalls of the groove with an angle of between 25 degrees and 60 degrees relative to a groove insertion axis which is parallel to the top surface, a second holding ramp in the opposite sidewall opposite the first holding ramp with an angle of between 25 degrees and 60 degrees relative to the groove insertion axis, and two substantially right angles opposite to each other near an entry of the groove;

providing a connector having two left-side sub-tongues extending in the direction of the groove insertion axis from a left side of a rectangular shaped base support element and two right-side sub-tongues from a right side of the base support element extending in a direction opposite to the direction that the first two sub-tongues extend, and outward extending distal catches on the sub-tongues in a direction substantially normal to the groove insertion axis; and inserting at least one of the left-side sub-tongues or the right-side sub-tongues with the distal catches into the groove along the groove insertion axis allowing two of four corners of the rectangular shaped base support element to fit into the two substantially right angles of the groove near the entry and the distal catches on the two right-side or two left-side sub-tongues to touch the first and second holding ramps causing the sub-tongues to flex;

wherein contact between the groove and the base support element resists further entrance of the sub-tongues into the groove.

2. The method of joining a panel to a connector of claim 1 wherein the sub-tongue is made of a flexible polymer.

3. The method of joining a panel to a connector of claim 2 wherein the flexible polymer is extrudable.

4. The method of joining a panel to a connector of claim 3 wherein the extrudable polymer is PVC or Polyethelene.

5. The method of joining a panel to a connector of claim 1 wherein contact between the sub-tongue and the groove is between the distal catches and the holding ramps.

6. The method of joining a panel to a connector of claim 5 wherein the sub-tongues are flexed when the distal catches are in contact with the groove holding ramps.

7. The method of joining a panel to a connector of claim 6 wherein contact between the distal catches and the holding ramps urges the sub-tongue into the groove.

8. The method of joining a panel to a connector of claim 5 wherein additional contact occurs between the base support element and the groove.

9. The method of joining a panel to a connector of claim 8 wherein contact between the groove and the base support resists further entrance of the sub-tongue into the groove.

10. A panel with a connector comprises:

a panel with a groove between a top surface and a bottom surface of the panel, the groove having opposing sidewalls, a first holding ramp in one of the sidewalls of the groove with an angle of between 25 degrees and 60 degrees relative to a groove insertion axis which is parallel to the top surface, a second holding ramp in the opposite sidewall opposite the first holding ramp with an angle of between 25 degrees and 60 degrees relative to the groove insertion axis, and two substantially right angles opposite to each other near an entry of the groove; and a connector having two left-side sub-tongues extending in the direction of the groove insertion axis from a left side of a rectangular shaped base support element and two right-side sub-tongues from a right side of the base support element extending in a direction opposite to the direction that the first two sub-tongues extend, and outward extending distal catches on the sub-tongues in a direction substantially normal to the groove insertion axis; and at least one of the left-side sub-tongues or the right-side sub-tongues with the distal catches inserted into the groove along the groove insertion axis allowing two of four corners of the rectangular shaped base support element to fit into the two substantially right angles of the groove near the entry and the distal catches on the two right-side or two left-side sub-tongues to touch the first and second holding ramps causing the sub-tongues to flex;

wherein contact between the groove and the base support element resists further entrance of the sub-tongues into the groove.

* * * * *